US009657403B2

(12) United States Patent
Kim et al.

(10) Patent No.: US 9,657,403 B2
(45) Date of Patent: May 23, 2017

(54) METHOD FOR PREPARING TIN-SILVER ALLOY PLATING SOLUTION AND PLATING SOLUTION PREPARED BY SAME

(71) Applicants: MSC CO., LTD., Incheon (KR); S&S CHEM CO., LTD., Yoeongi-gun Chungcheongnam-do (KR); Dong Hyun Kim, Jeju-si, Jeju-do (KR); Tae Jo Bang, Anyang-si, Gyeonggi-do (KR)

(72) Inventors: Dong Hyun Kim, Jeju-si (KR); Tae Jo Bang, Anyang-si (KR); Jeong Hun Oh, Siseung-si (KR); Jin Ho Son, Anyang-si (KR); Hong Ki Kim, Seoul (KR); Jeong Dae Kim, Cheongju-si (KR); Jeong Nan Yuk, Bucheon-si (KR)

(73) Assignees: MSC CO., LTD., Incheon (KR); S&S CHEM CO., LTD., Yeongi-gun, Chungcheongnam-do (KR); Dong Hyun Kim, Jeju-si, Jeju-do (KR); Tae Jo Bang, Anyang-si, Gyeonggi-do (KR)

( * ) Notice: Subject to any disclaimer, the term of this patent is extended or adjusted under 35 U.S.C. 154(b) by 97 days.

(21) Appl. No.: 14/363,225

(22) PCT Filed: Dec. 6, 2012

(86) PCT No.: PCT/KR2012/010540

§ 371 (c)(1),
(2) Date: Jun. 5, 2014

(87) PCT Pub. No.: WO2013/085304

PCT Pub. Date: Jun. 13, 2013

(65) Prior Publication Data

US 2014/0318982 A1 Oct. 30, 2014

(30) Foreign Application Priority Data

Dec. 9, 2011 (KR) ..... 10-2011-0132232

(51) Int. Cl.
*C25D 3/56* (2006.01)
*C25D 3/60* (2006.01)
(Continued)

(52) U.S. Cl.
CPC ..... *C25D 3/56* (2013.01); *C25D 3/60* (2013.01); *C25D 3/64* (2013.01); *C25D 21/12* (2013.01)

(58) Field of Classification Search
CPC ..... C25D 3/60; C25D 3/64
(Continued)

(56) References Cited

U.S. PATENT DOCUMENTS 6,797,142 B2 * 9/2004 Crosby ..... B32B 15/01 106/1.25
2002/0104763 A1 * 8/2002 Yanada ..... C25D 3/60 205/241
(Continued)

FOREIGN PATENT DOCUMENTS

JP 09-165694 A 6/1997
JP 10-036999 A 2/1998
(Continued)

OTHER PUBLICATIONS

Manocha, "Porous Carbons," Sadhana (Feb./Apr. 2003), vol. 28, Parts 1 & 2, pp. 335-348.*

*Primary Examiner* — Edna Wong
(74) *Attorney, Agent, or Firm* — Novick, Kim & Lee, PLLC; Jae Youn Kim

(57) ABSTRACT

A method is described of preparing a tin-silver (Sn—Ag) alloy plating solution containing methanesulfonic acid tin, methanesulfonic acid silver, methanesulfonic acid, and an additive, wherein the method includes: (a) eliminating impurities such as released chloride compounds and released sulfur compounds, which are present in the methanesulfonic
(Continued)

acid, (b) preparing the methanesulfonic acid tin and the methanesulfonic acid silver by dissolving, through an electrolytic process, tin and silver in the methanesulfonic acid from which the impurities are eliminated; (c) producing a mixture solution by adding the methanesulfonic acid, the methanesulfonic acid tin, the methanesulfonic acid silver, and the additive; and (d) filtering the mixture solution. And by the method thereof, current efficiency may be increased and a desirable plating film may be maintained by eliminating the impurities from the methanesulfonic acid used as a base material and preparing the Sn—Ag alloy plating solution.

1 Claim, 1 Drawing Sheet

(51) Int. Cl.
*C25D 3/64* (2006.01)
*C25D 21/12* (2006.01)

(58) Field of Classification Search
USPC ..... 205/238, 252
See application file for complete search history.

(56) References Cited

U.S. PATENT DOCUMENTS

| | | | | |
|---|---|---|---|---|
| 2005/0070614 | A1* | 3/2005 | Richards | C01B 3/34 518/700 |
| 2006/0113006 | A1* | 6/2006 | Masuda | C25D 3/60 205/302 |

FOREIGN PATENT DOCUMENTS

| | | | | |
|---|---|---|---|---|
| JP | 2005126753 | A * | 5/2005 | C25D 21/14 |
| KR | 10-0268967 | B1 | 10/2000 | |
| KR | 10-2003-0025857 | A | 3/2003 | |
| KR | 10-2005-0092132 | A | 9/2005 | |
| WO | WO 2004065663 | A1 * | 8/2004 | C25D 3/32 |

* cited by examiner

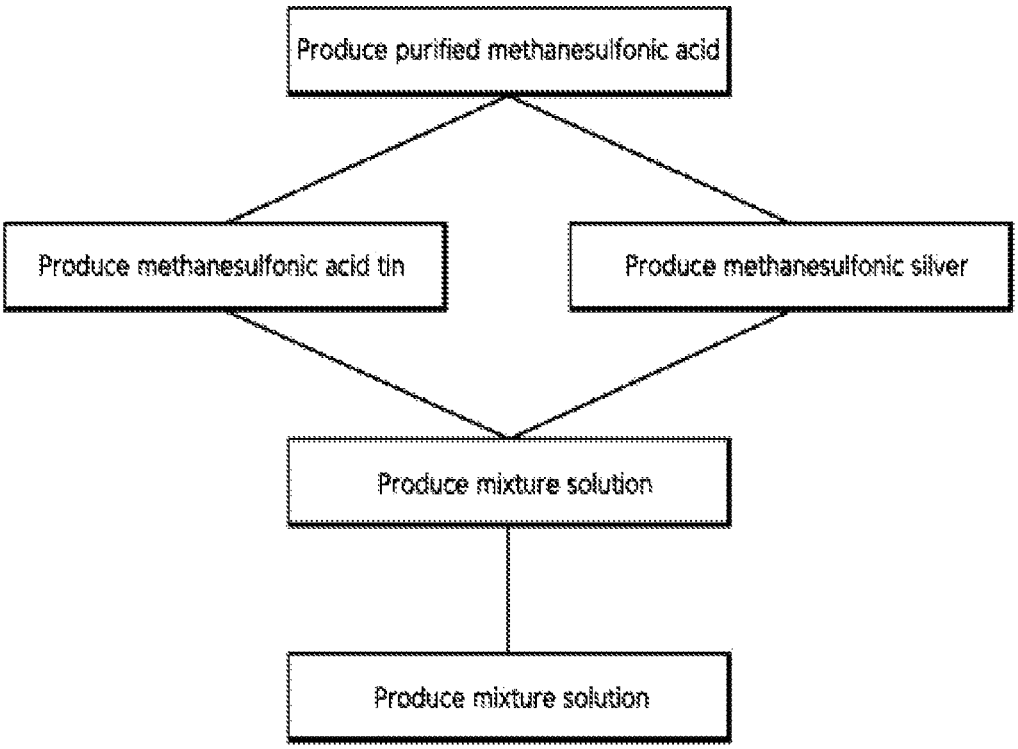
Produce purified methanesulfonic acid
Produce methanesulfonic acid tin
Produce methanesulfonic silver
Produce mixture solution
Produce mixture solution

METHOD FOR PREPARING TIN-SILVER ALLOY PLATING SOLUTION AND PLATING SOLUTION PREPARED BY SAME

CROSS-REFERENCE TO RELATED APPLICATION

This application claims the priority benefit of Korean Patent Application No. 10-2011-0132232, filed on Dec. 9, 2011, in the Korean Intellectual Property Office, the disclosure of which is incorporated herein by reference.

BACKGROUND

1. Field of the Invention

The present invention relate to a method of preparing a tin-silver (Sn—Ag) alloy plating solution, and particularly, to a method of preparing a Sn—Ag alloy plating solution and the plating solution thereby, wherein the method may increase current efficiency and maintain a desirable plating film by eliminating impurities from methanesulfonic acid, which is a base material, in the preparation of methanesulfonic acid tin and methanesulfonic acid silver through an electrolytic process.

2. Description of the Related Art

In general, plating a product or parts of the product may be a necessary process applied to most of the industrial fields. Specifically, the plating may be a significant factor to determine the quality and productivity of mass-produced products in semiconductor manufacturing sites where a light, thin, short, and small product is desirable. Purification technique, thus, may be required to prevent contamination and increase purity of a plating solution by eliminating impurities contained in the plating solution. For example, Korean Patent Publication No. 2005-0092132 entitled "tin-containing plating bath" and Japanese Patent Publication No. 2001-64249 entitled "purification of alkanesulfonic acid" disclose related technologies.

In one working example, the Korean Patent Publication No. 2005-0092132 discloses the tin-containing plating bath that contains (a) a first soluble tin salt or a mixture of the first soluble tin salt and at least one soluble salt selected from the group consisting of copper salt, bismuth salt, silver salt, indium salt, zinc salt, nickel salt, cobalt salt, and antimonial salt, and (b) tin containing at least one aliphatic sulfonic acid selected from the group consisting of alkanesulfonic acid and alkanolsulfonic acid, wherein the aliphatic sulfonic acid may be purified aliphatic sulfonic acid that contains less than a small amount of sulfur compounds, as impurities, including a compound having sulfur atoms with an oxidation number of +4 or less in a molecule and a compound having sulfur atoms and chloride atoms in a molecule. Thus, a tin plating film or a tin alloy plating film that may have a desirable reflow property and exterior will be formed thereby.

In another working example, the Japanese Patent Publication No. 2001-64249 discloses a purification method. The purification method may include at least one step of bringing aqueous alkanesulfonic acid solution into contact with alkaline anion exchange resin, wherein the method may be performed to purify alkanesulfonic acid to reduce a content of sulfuric acid and, additionally, a content of anion other than alkansulfonate ion contained therein, and, specifically, wherein the method may be performed to reduce the content of the sulfuric acid. Thus, the reduction in the content of the sulfuric acid in the alkanesulfonic acid may be achieved by bringing the aqueous alkanesulfonic acid solution into contact with the alkaline anion exchange resin.

However, various substances including chloride ion, in addition to sulfur compounds, may be used when synthesizing a commercially available methanesulfonic acid. Moreover, the chloride ion may adversely affect a structure of a plating film.

RELATED ART (Patent Document) Korean Patent Publication No. 2005-0092132 entitled "tin-containing plating bath"

(Patent Document) Japanese Paten Publication No. 2001-64249 entitled "purification of alkanesulfonic acid"

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one aspect, the present invention provides a method of preparing a tin-silver (Sn—Ag) alloy plating solution by eliminating impurities from methanesulfonic acid, a base material, in the preparation of methanesulfonic acid tin and methanesulfonic acid silver through an electrolytic process, and the Sn—Ag alloy plating solution that may increase current efficiency and maintain a desirable plating film.

In another respect, the present invention provides a method of preparing a Sn—Ag alloy plating solution including methanesulfonic acid tin, methanesulfonic acid silver, methanesulfonic acid, and an additive, the method including: (a) eliminating impurities, such as released chloride compound and released sulfur compound, which are present in the methanesulfonic acid; (b) preparing the methanesulfonic acid tin and the methanesulfonic acid silver by dissolving, through an electrolytic process, tin and silver in the methanesulfonic acid from which the impurities are eliminated; (c) producing a mixture solution by adding the methanesulfonic acid, the methanesulfonic acid tin, the methanesulfonic acid silver, and the additive; and (d) filtering the mixture solution.

The said elimination step may include eliminating the impurities present in the methanesulfonic acid and purifying the methanesulfonic acid by applying activated carbon filtration and/or distillation.

The activated carbon used therein to eliminate the impurities may have an average size of 40 to 50 μm, a specific surface area of 800 $m^2/g$ or higher, and an average pore diameter of 10 to 20 Å.

In another aspect, the present invention provides a Sn—Ag alloy plating solution including methanesulfonic acid tin, methanesulfonic acid silver, methanesulfonic acid, and an additive, wherein chloride compound and sulfur compound, which are released in the methanesulfonic acid, the methanesulfonic acid silver, and the methanesulfonic acid through the elimination impurities from the methanesulfonic acid, may be maintained to be less than or equal to 5 ppm and 15 ppm, respectively, and the chloride compound released in an initially prepared Sn—Ag alloy plating solution may be less than or equal to 5 ppm.

The additive may include an antioxidant, a surfactant, a complexing agent, and a crystal grain refining agent.

The foregoing summary is illustrative only and is not intended to be in any way limiting. Other features and aspects will be apparent from the following detailed description, the drawings, and the claims.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which:

FIG. 1 is a block diagram sequentially illustrating a method of preparing a tin-silver (Sn—Ag) alloy plating solution in accordance with the embodiment of the present invention.

DETAILED DESCRIPTION

Reference will now be made in detail to exemplary embodiments of the present invention, examples of which are illustrated in the accompanying drawings, wherein the like reference numerals refer to the like elements throughout. Exemplary embodiments are described below to explain the present invention by referring to the accompanying drawings. However, the present invention is not limited thereto or restricted thereby.

When it is determined that a detailed description related to a related known function or configuration would make the purpose of the present invention unnecessarily ambiguous in describing the present invention, the detailed description will be omitted here. Also, the terms used herein are defined to appropriately describe the exemplary embodiments of the present invention and thus may be changed depending on a user, the intent of an operator, or a custom. Accordingly, the terms must be defined based on the following overall description of this specification.

The embodiments of the present invention relate to a method of preparing a tin-silver (Sn—Ag) alloy plating solution based on methanesulfonic acid and to the plating solution prepared thereby. For example, the plating solution may be used for plating solder bumps used in flip-chip semiconductor package.

A commercially available methanesulfonic acid may be obtained by adding chlorine to methyl mercaptan, preparing methanesulfonyl chloride, and synthesizing methanesulfonic acid. Here, the methanesulfonic acid and hydrochloric acid may be simultaneously synthesized, and the hydrochloric acid may be eliminated through purification. However, the hydrochloric acid may not be completely eliminated from the commercially available methanesulfonic acid and may remain within a concentration of some to tens of ppm in the methanesulfonic acid. The remaining hydrochloric acid may lower plating efficiency in a process of plating in an actual mass-production site and adversely affect a plating film, which may result in a higher defect rate. Also, sulfur compounds that are additionally produced when synthesizing the methanesulfonic acid may affect the characteristics of the plating. The Sn—Ag alloy plating solution disclosed herein may include methanesulfonic acid, methanesulfonic acid tin, methanesulfonic silver, and a small amount of an additive. The additive may include an antioxidant, a complexing agent, and a crystal grain refining agent.

In accordance with an embodiment of the present invention, the method of preparing the Sn—Ag alloy plating solution may include preparing the plating solution from which impurities, for example, released chloride compounds, are eliminated by applying the first step through the fourth step.

The first step may include eliminating impurities, for example, released chloride compounds and released sulfur compounds, which are present in the methanesulfonic acid. The commercially available methanesulfonic acid may include various impurities such as chloride ion, in addition to the sulfur compounds. Here, activated carbon, which is economically feasible and have a broad specific surface area, may be effectively used to eliminate the impurities.

At the first step of eliminating the impurities, the activated carbon having an average size of 40 to 50 μm, a specific surface area of 800 $m^2/g$ or higher, and an average pore diameter of 10 to 20 Å may desirably be selected to filter out the released chloride compounds and the released sulfur compounds. When the pore diameter is excessively small and the specific surface area is excessively broad, productivity may be reduced while product quality may be improved. Conversely, when the pore diameter is excessively large and the specific surface area is excessively small, product quality may be reduced while productivity may be improved.

The second step may include preparing the methanesulfonic acid tin and the methanesulfonic acid silver by dissolving tin and silver, respectively, in the methanesulfonic acid from which the impurities are eliminated through the electrolytic process. The tin may be dissolved in the purified methanesulfonic acid through the electrolytic process to prepare the methanesulfonic acid tin. The prepared methanesulfonic acid tin may be stored in a separate container. Similarly, the silver may be dissolved in the purified methanesulfonic acid through the electrolytic process to prepare the methanesulfonic acid silver. The prepared methanesulfonic acid silver may be stored in a separate container.

Here, in terms of both improvement in the quality of the plating solution and reduction in production cost, it may be desirable to maintain the released chloride compounds to be less than or equal to 5 ppm and the released sulfur compounds to be less than or equal to 15 ppm, respectively, in the methanesulfonic acid, the methanesulfonic acid tin, and the methanesulfonic acid silver.

The third step may include producing a mixture solution by adding the methanesulfonic acid, the methanesulfonic acid tin, the methanesulfonic acid silver, and the additive. The produced base material may be placed in a container and stirred 5 to 15 times per minute using a stirrer with a churn dasher.

The fourth step may include filtering the mixture solution. The mixture solution on which the stirring is performed may be physically filtered to eliminate precipitates or impurities therefrom.

Here, in terms of improvement in the quality of the plating solution and reduction in the production cost, it may be desirable to maintain the released chloride compounds to be 5 ppm in the final product of Sn—Ag alloy plating solution.

Hereinafter, the effects of the present invention will be further described with reference to Examples and Comparative Examples.

Example 1

One liter of a commercially available methanesulfonic acid prior to purification was added to a beaker and distilled at 90° C. for 12 hours. The methanesulfonic acid was fully cooled, and the same amount of ultrapure methanesulfonic acid as the amount evaporated was added to make the volume of mixture solution 1 L again. Subsequently, 50 g of activated carbon A was added and left in the beaker while being gradually stirred for 24 hours. The activated carbon was eliminated using a 5 C filter paper from the methanesulfonic acid on which the process using the activated carbon was performed. The activated carbon was finally eliminated using a 1 μm cartridge filter. After the purification, methanesulfonic acid tin (tin: 300 g/L) and methanesulfonic acid silver (silver: 150 g/L) were prepared through an electrolytic process. Then, a Sn—Ag alloy plating solution was prepared as follows:

Methanesulfonic acid tin (based on tin): 70 g/L
Methanesulfonic acid silver (based on silver): 1 g/L
Methanesulfonic acid (purified): 150 g/L
Additive: required amount Here, an average size, a specific surface area, and an average pore diameter of the activated carbon A were set as 45 μm, 950 $m^2/g$ or higher, and 17 Å, respectively.

Example 2

The distillation without the process using activated carbon was performed on methanesulfonic acid in the purification process. The rest processes were identically performed as in Example 1.

Example 3

The process using activated carbon without distillation was performed on methanesulfonic acid in the purification process. The rest processes were identically performed as in Example 1.

Example 4

The purification process was performed on methanesulfonic acid using activated carbon B. The rest processes were identically performed as in Example 1. Here, an average size, a specific surface area, and an average pore diameter of the activated carbon B were set as 87 μm, 600 $m^2/g$ or higher, and 32 Å, respectively.

Example 5

The purification process was performed on methanesulfonic acid using activated carbon C. The rest processes were identically performed as in Example 3. Here, an average size, a specific surface area, and an average pore diameter of the activated carbon B were set as 36 μm, 1200 $m^2/g$ or higher, and 14 Å, respectively.

Comparative Example 1

Methanesulfonic acid tin (tin: 300 g/L) and methanesulfonic acid silver (silver: 150 g/L) were prepared through an electrolytic process using a commercially available methanesulfonic acid prior to purification. Accordingly, a Sn—Ag alloy plating solution was prepared as follows:

Methanesulfonic acid tin (based on tin): 70 g/L
Methanesulfonic acid silver (based on silver): 1 g/L
Methanesulfonic acid (commercially available): 150 g/L
Additive: the amount as required Comparative Example 2

A small amount of hydrochloric acid was added to the Sn—Ag alloy plating solution of Example 1 to allow chloride ion to be 10 ppm.

Comparative Example 3

A small amount of sulfuric acid was added to the Sn—Ag alloy plating solution of Example 1 to allow sulfate ion to be 30 ppm.

[Experimental Results]

Experiments were conducted on the Sn—Ag alloy plating solutions of Examples 1 through 5 and Comparative Examples 1 through 3 to evaluate their respective characteristics. The results thereof are shown below in Table 1 and Table 2.

In the analysis of the impurities in methanesulfonic acid, chloride compounds and sulfur compounds in the methanesulfonic acids, the methanesulfonic acid tins, the methanesulfonic acid silvers, and the Sn—Ag alloy plating solutions were analyzed through high performance liquid chromatography (HPLC).

In the evaluation of the plating, 5 minute constant-current plating was conducted under the conditions of a cathode with a copper surface of the cross-sectional area of 5 cm×5 cm, an anode with a platinum coated titanium electrode at a current density of 5 $A/cm^2$. Here, the plating solution was stirred 10 times per minute on a side of the cathode using a churn dasher.

In the evaluation of an exterior of a plating film, the plating film was observed with naked eyes through a magnifying lens. Here, evaluation criteria are shown as follows:

◎ (Excellent): favorably glossy plating film, without spots and unevenness

○ (Good): partially cloudy plating film, without spots

Δ (Not Good): cloudy plating film, with an uneven exterior of plating film and a few of spots X (Bad): spots on all sides or burnt plating Analysis of the content of Ag in plating film: The ratio of the contents of the Sn and Ag were measured using XRF.

TABLE 1

Result of Impurity Analysis (unit: ppm)

| | Methanesulfonic acid | | Methanesulfonic acid tin | | Methanesulfonic acid silver | | Sn—Ag alloy plating solution |
|---|---|---|---|---|---|---|---|
| | Chloride Ion | Sulfate ion | Chloride ion | Sulfate ion | Chloride ion | Sulfate ion | Chloride ion |
| Ex. 1 | 2.4 | 6.6 | 3.3 | 6.5 | 2.8 | 7.1 | 3.5 |
| Ex. 2 | 4.1 | 8.6 | 4.1 | 8.9 | 4.5 | 8.3 | 4.3 |
| Ex. 3 | 3.8 | 8.4 | 3.5 | 7.9 | 3.8 | 8.5 | 4.1 |
| Ex. 4 | 7.3 | 12.8 | 7.1 | 13.1 | 7.4 | 11.9 | 8.4 |
| Ex. 5 | 3.6 | 9.2 | 3.5 | 8.9 | 3.7 | 9.6 | 3.9 |
| Comp. Ex. 1 | 14.2 | 28.5 | 15.3 | 30.4 | 15.2 | 29.9 | 16.0 |
| Comp. Ex. 2 | | | | | | | 13.5 |
| Comp. Ex. 3 | | | | | | | 3.6* |

In Table 1 above, "*" in Comparative Example 3 indicates that 30 ppm of sulfuric acid was added.

TABLE 2

| Result of Plating Evaluation | | | |
|---|---|---|---|
| | Current efficiency (%) | Plating exterior | Ag content (%) |
| Ex. 1 | 96% | ◎ | 3.1% |
| Ex. 2 | 95% | ◎ | 3.2% |
| Ex. 3 | 95% | ◎ | 3.0% |
| Ex. 4 | 94% | ○ | 3.3% |
| Ex. 5 | 96% | ◎ | 3.1% |
| Comp. Ex. 1 | 93% | ○ | 3.5% |
| Comp. Ex. 2 | 91% | Δ | 3.7% |
| Comp. Ex. 3 | 93% | Δ | 3.6% |

The comparison of Examples 1, 2, and 3 with each other indicates that using the purified methanesulfonic acid in the preparation of the Sn—Ag alloy plating solution did not greatly affect plating performance.

The comparison of Examples 1, 4, and 5 with each other indicates that selecting activated carbon was an important factor in improving the efficiency of purification using activated carbon.

The comparison of Examples with Comparative Examples indicates that a chloride component affected the plating performance more conspicuously than other impurities.

Accordingly, a plating solution having an even plating film at a high speed may be prepared by eliminating impurities, specifically, released chloride compounds, from raw materials constituting the plating solution, and thereby controlling the amount of the impurities in a final product.

In the exemplary embodiments of the present invention, current efficiency may increase and a desirable plating film may be maintained by eliminating impurities from methanesulfonic acid, which is a base material, and preparing a Sn—Ag alloy plating solution.

In addition, in the exemplary embodiments of the present invention, using a purified Sn—Ag alloy plating solution may improve characteristics of plating, and adjust an exterior of a plating film and the content of silver in the plating film.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A method of preparing a tin-silver (Sn—Ag) alloy plating solution comprising methanesulfonic acid tin, methanesulfonic acid silver, methanesulfonic acid, and an additive, the method comprising:

preparing the methanesulfonic acid by eliminating impurities therein, the impurities comprising released chloride compounds and released sulfur compounds;

preparing the methanesulfonic acid tin and the methanesulfonic acid silver by dissolving, through an electrolytic process, tin and silver in a part of the prepared methanesulfonic acid;

producing a mixture solution by adding a part of the prepared methanesulfonic acid, the methanesulfonic acid tin, the methanesulfonic acid silver, and the additive; and filtering the mixture solution, wherein:

the preparing the methanesulfonic acid by eliminating impurities therein comprises applying activated carbon filtration, and the applied activated carbon has an average size of 40 to 50 μm, a specific surface area of 800 $m^2/g$ or higher, and an average pore diameter of 10 to 20 Å.

* * * * *